US010472884B2

(12) United States Patent
Maytorena

(10) Patent No.: US 10,472,884 B2
(45) Date of Patent: Nov. 12, 2019

(54) DOORWAY AND PASSAGE BARRIER

(71) Applicant: Roberto Maytorena, Chula Vista, CA (US)

(72) Inventor: Roberto Maytorena, Chula Vista, CA (US)

( * ) Notice: Subject to any disclaimer, the term of this patent is extended or adjusted under 35 U.S.C. 154(b) by 54 days.

(21) Appl. No.: 15/655,704

(22) Filed: Jul. 20, 2017

(65) Prior Publication Data

US 2019/0024447 A1 Jan. 24, 2019

(51) Int. Cl.

| | |
|---|---|
| ***E06B 9/02*** | (2006.01) |
| ***E06B 11/02*** | (2006.01) |
| ***E04H 17/00*** | (2006.01) |
| *E06B 9/00* | (2006.01) |

(52) U.S. Cl.

CPC ..... *E06B 9/02* (2013.01); *E04H 17/003* (2013.01); *E06B 11/02* (2013.01); *E06B 2009/002* (2013.01)

(58) Field of Classification Search

CPC .... E06B 9/02; E06B 9/0692; E06B 2009/002; E04H 17/003

See application file for complete search history.

(56) References Cited

U.S. PATENT DOCUMENTS

| | | | | | |
|---|---|---|---|---|---|
| 321,171 | A * | 6/1885 | Archibald | E04H 17/00 | 256/12 |
| 435,708 | A * | 9/1890 | Poole | E04H 17/00 | 256/12 |
| 504,936 | A * | 9/1893 | Niles | E04H 17/00 | 256/12 |
| 511,700 | A * | 12/1893 | Jacobs | E04H 17/00 | 256/12 |
| 5,293,721 | A * | 3/1994 | Richard | A01K 39/0113 | 114/221 R |
| 6,585,233 | B1 * | 7/2003 | Sorben | A01K 3/00 | 256/1 |
| 2010/0229802 | A1 * | 9/2010 | Bok | A01K 3/00 | 119/416 |
| 2013/0227888 | A1 * | 9/2013 | Nur-Tegin | E05D 15/02 | 49/226 |
| 2014/0170366 | A1 * | 6/2014 | Whooley | E06B 9/02 | 428/81 |

* cited by examiner

*Primary Examiner* — Justin B Rephann
(74) *Attorney, Agent, or Firm* — Donn K. Harms

(57) ABSTRACT

A doorway and passage barrier having a plurality of freely rotating members engaged upon a mounting member positioned upon a top edge of a frame of a child or pet barrier. The rotating members positioned adjacent the top edge of the frame form a bi-rotational shield preventing stationary contact with the top edge of the frame, thereby preventing a child or pet from using the top edge of the frame as a hand grip or foot positioner to climb over the barrier.

4 Claims, 4 Drawing Sheets

DOORWAY AND PASSAGE BARRIER

FIELD OF THE INVENTION

The present invention relates to the temporary prevention of movement through a door, hallway, or passage. More particularly, the disclosed device relates to a rotating barrier which is removably positionable upon or as part of a gate, in a doorway or hallway or the like, and which prevents walking or crawling therethrough by infants and toddlers and pets by forming an rotating unclimbable barrier.

BACKGROUND OF THE INVENTION

In modern times, babies, infants, and pets living in a home generally are under constant supervision by parents or guardians. This is because in the modern home there are many hazards which a toddler or infant might encounter which can harm or seriously injure them. While older children may have been taught or learned to avoid such hazards, babies, and especially toddlers who are learning to walk, and concurrently are extremely inquisitive and explorative, have no such knowledge nor any learned avoidance of such hazards.

As a consequence, a majority of parents choose to employ a barrier which can be permanently or temporarily removably positioned in key doorways and passageways in the home, to prevent passage to the hazards beyond the gate. Further, such barriers are also employed simply to maintain an infant or child in a confined space where the parent or guardian can have them under continuous observation and direct their activities in a constructive and safe manner. Many pet owners also choose to limit the area of the home a pet, such as a dog, can occupy.

Such barriers are commonly known as a baby gates or child safety gates and they provide a protective barrier configured to prevent babies and toddlers from accessing areas of a home where they might be unsafe, such as stairways, bathrooms, and kitchens. Such baby gates are conventionally constructed of metal, plastic and/or wood, and can be formed to a single width, or can be configured to expand and contract in width to allow temporary removable engagement within a range of doorway, hallway, and passageway widths.

In such configurations, baby gates may be hardware mounted or pressure-mounted or adapted for a pressure mount which also includes a hardware connection to wall or door surfaces. This allows the parent or guardian to position one or more baby gates in key passageways of a home, to prevent passage beyond the installed gate.

Pressure-mounted gates are conventionally held in a removable engagement in a passageway by friction with the walls or doorjambs or the like on the opposing side edges. Hardware-mounted gates are conventionally screwed into the wall studs and may employ hinges or the like to allow them to swing fully open like a door.

However, whether such gates are positioned to restrict passage by babies, toddlers, or pets, a significant problem arises where the child reaches an age where they can climb over impediments to their path. This is a similar issues with pets such as dogs who are able to pull themselves over or leap over a gate or the like.

Small children inherently seem to reach an age where they learn the physical skills to climb over anything blocking their path, if possible. Unfortunately, their learned physical skills for climbing, generally surpasses their learned aversion to dangerous or potentially harmful situations which are present in every home such as water filled bathtubs, hot stoves, doorways to the exterior of the home, and a plethora of other dangers for which a small child is not ready to encounter.

Conventional baby gate devices generally have a flaw in preventing climbing-capable children and pets from climbing over the engaged baby gate barrier. Because the top edge of such gates are fixed in position, children can get a hand hold and or foot hold on the top edge of the installed baby gate, and pull themselves up and over it. While some baby gates have attempted to prevent this behavior by placing a rotating member as or on the top edge, where the member only rotates one direction, or where a child can grip the rotating member and block its rotation such as jamming their hand between the rotating member and the top edge of the gate, children learn quickly they can climb over the gate. Pets such as dogs are also quick to learn placing their paws in a position where it prevents rotation of the rotating member, will allow them sufficient contact to leap over the gate. As a consequence, preventing the child encountering a baby gate from climbing it, continues to be an ongoing concern. The forgoing examples of barriers such as baby gates employed for preventing passage of children and pets past the mounting position of the barrier, and the limitations related therewith, are intended to be illustrative and not exclusive. The disclosed examples and background does not imply any limitations on the invention described and claimed herein. Various other limitations of the related art of baby gates and barriers are known, or such will become apparent to those skilled in the art upon a reading and understanding of the specification below and the accompanying drawings.

SUMMARY OF THE INVENTION

The device and system herein disclosed and described provides a solution to the shortcomings in prior art of barriers and baby gates which are positioned to prevent passage past their mounting point. The device herein disclosed provides this solution to the ever present danger of a small child climbing past or over a barrier or gate which is installed to prevent their passage past it, and thereby protect them.

Where provided in combination with the gate itself, the device herein features a baby gate adapted for either hardware or frictional engagement in doorways, hallways, and other passageways, at a point where a user wishes to prevent a child from passing beyond, which includes a rotating top barrier. In such a combined component, the device features a metal frame formed in a fashion to prevent passage through the formed frame. The frame may be of fixed size, or may be formed to telescopically, or translationaly, expand and contract to various widths to allow the frame to be positioned in a door or hallway or the like, with both side surfaces in contact with, or immediately adjacent, to the wall surface. So positioned, with an engaged rolling barrier suspended over the top edge of the frame, the device will prevent an infant and small animal from passing through or over, and therefor beyond, the frame of the removably engaged gate.

Prevention from climbing over the top edge of the removably positioned gate, is provided by rolling barrier featuring a mounting member positioned a distance above the top edge of the frame of the gate. The mounting member provides a bi-rotational mount, for each of a plurality of adjacently positioned rotating members rotationally engaged on the mounting member, which form an elongated shield preventing contact with a top edge of the frame forming the gate or barrier. Instead, a child or animal trying to get past the frame of the gate or barrier contacts the freely rotating members. This rolling shield or barrier can be provided as an addition to the frame of an existing gate or the like, or, it may as noted, be provided in combination with such a frame, as a single unit.

Preferably, the diameter of each such rotating member larger than the grip of the hand of an infant or toddler which currently is a diameter of 2.5 to 3.5 inches. Additionally, the central passage through each rotating member is sized to rotationally engage upon the mounting member, and position the exterior circumferential edge of each rotating member immediately adjacent a top edge of the frame of the device. By immediately adjacent is meant that a gap substantially between a 1/32 inches to 1/4 inches is present and is too small for a child to position their finger between the exterior circumferential surface and the edge of the gate. By substantially, where used herein in any fashion, is meant plus or minus 10% of the state range or value.

Each rotating member is engaged upon the mounting member in a fashion allowing it to rotate freely either direction. This dual direction rotation was found, in experimentation, to prevent children attempting to climb the gate from doing so, by preventing them from obtaining a fixed hand hold, or hand positioning on top any one or a plurality of rotating members positioned above the top edge of the gate.

While at first a single direction rotation of the rolling barrier was originally tried, as a means to prevent movement in a forward direction, it was found that it was easy for a child to learn to push the rotating members in the direction of non rotation, while leaning over the top of the gate, and a child could thus push in the direction of non rotation, while scaling over the top edge of the gate. If a step or box were dragged next to the gate during the attempt, which is a well learned behavior of most ingenious toddlers, the feet of the climber can quickly move over the top while in this position.

Positioning each of a plurality of rotating members upon the mounting member, where they each rotate freely in either direction, was found to solve this problem since the child could not learn to lean forward or rearward on the rotating member to stop rotation, while concurrently attempting to bound over the gate. When coupled with individual rotating members which are sized to prevent a grip thereon by a child, the device further inhibited gripping and balancing on the rotating members during attempted passage thereover. The mounting member engaged to mounts, with rotating members thereon, can be provided as an add-on unit where the mounts engage an existing gate or barrier, or in combination with a gate or barrier adapted to operative positioning in the passage or door to be blocked.

In all modes of the device herein, whether provided as a rotating barrier engageable with a frame, or in combination therewith, preferably each rotating member, has an annular projection extending from one side surface thereof through which the central passage communicates. On the side of each rotating member opposite that of the annular projection, a recess is positioned through which the central passage runs. This configuration allows a plurality of individual rotating members to be positioned upon the mounting member abutting each other but allows for the frame to be expanded which positions gaps between the sides of the rotating members.

These annular projections, however, prevent finger or other contact with the mounting member through such gaps. Instead, any positioning of a hand or finger in a gap, will contact an annular projection. This positioning of an annular projection in each gap when present is preferred as it prevents a child's hand or finger or hair from coming into a position between the stationary mounting member and the central passage of a rotating member where pinching or hair pulling or the like could occur during a rotation of a rotating member on the stationary mounting member. Further, the provision of this annular projection and recessed engagement in gaps, allows for use of rotating members with non planar sides, with significantly reduced fear of pinching or such since the annular members will position in each gap and rotate concurrently with each respective rotating member.

The plurality of rotating members may have planar side surfaces, or as noted, non planar sides. The rotating members may be familiar shapes such as fruits or whimsical shapes or cartoon characters. Further, they may be formed in different colors, or with indicia thereon allowing spelling of words. Still further, in one mode of the device, the rotating members can be enabled with an emitter component which generates one or both of sound and light when the rotating member is positioned to intersect a trigger for the emitter, such as light from an LED communicated to energize or trigger the emitter to broadcast light or sound.

With respect to the above description, before explaining at least one preferred embodiment of the gate or barrier disclosed and described herein in detail, it is to be understood that the invention is not limited in its application to the details of construction and to the arrangement of the components in the following description or illustrated in the drawings. The barrier or gate invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other baby gate devices and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of this invention to provide a baby or pet gate device which is removably engageable between walls or passages or door jambs, to prevent passage therethrough.

It is another object of the present invention to provide such a removably engageable gate, which is configured with a rotating barrier, to prevent climbing over a top edge thereof.

It is an additional object of this invention to provide such a baby gate which employs a plurality of rotating members mounted above a top edge, which can also be employed for entertainment and educational purposes.

It is yet another object of this invention, to provide the plurality of rotating members on a mounting member operatively engaged with a mount, which can be retrofitted to existing gates and barriers.

These and other objects, features, and advantages of the disclosed baby gate invention, as well as the advantages thereof over existing prior art, which will become apparent from the description to follow, are accomplished by the improvements described in this specification and hereinafter described in the following detailed description, which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed doorway or passage barrier device herein also described as a baby gate. It is intended that the embodiments and figures disclosed herein are to be considered illustrative of the invention herein, rather than limiting in any fashion.

In the drawings:

FIG. 1 depicts a side plan view of the rotating barrier device herein engaged with a frame of a gate, showing side edges of the frame configured for hardware or frictional engagement with two wall surfaces, and showing a plurality of rotating members operatively engaged upon a horizontal mounting member mounted above the top of the frame, defining a freely rotating shield preventing direct contact with the top edge of the frame.

DETAILED DESCRIPTION OF THE INVENTION

Figure 1:
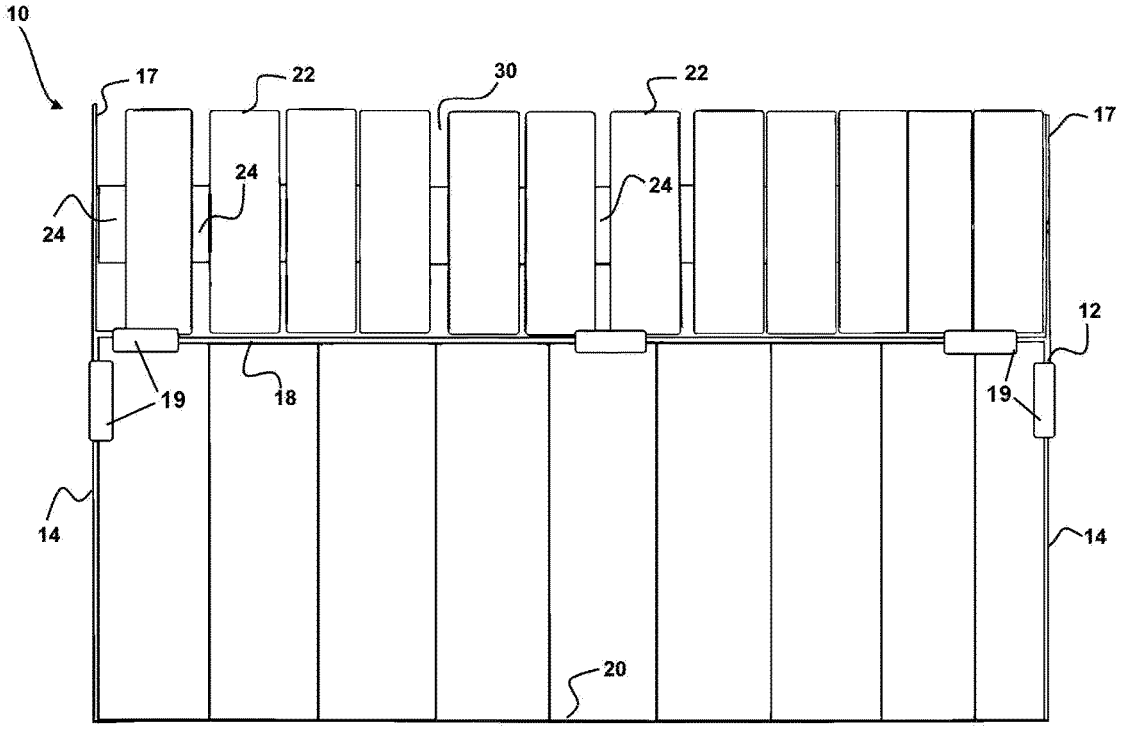

In this description, the directional prepositions of up, upwardly, down, downwardly, front, back, top, upper, bottom, lower, left, right and other such terms of direction or position, refer to the device as it is oriented and appears in the drawings and are used for convenience only, and such are not intended to be limiting or to imply that the device has to be used or positioned in any particular orientation.

Now referring to drawings in FIGS. 1-11, wherein similar components are identified by like reference numerals, there can be seen in FIG. 1 the barrier device 10 herein which is especially well configured to operate as a baby gate or pet barrier. In all modes the device 10 includes a frame 12 which is configured for positioning of sides 14 of the frame 12 in contact with or immediately adjacent to an opposing side surfaces of the passage being blocked, such as a doorjamb or hallway or the like. This frame 12 may be provided in combination with the opposing mounts 17 and mounting member 16 having freely rotating members 22 thereon.

As noted, alternatively, the mounts 17 can be provided in a mounting assembly, where the mounting assembly includes a pair of mounts 17, each of which is engageable with an existing frame 12 or barrier, using connectors 19 having slots 21 to engage the frame 12 and thereby position the mounting member 16 and engaged rotating members 22 above the top edge of an existing frame 12 or barrier. Of course, other connectors 19 as would occur to those skilled in the art may be used. However, the slotted 21 connectors 19 worked especially well in a frictional engagement which is then secured by a screw (not shown) impacting against the frame 12 surface to fix that slotted engagement.

Figure 2:
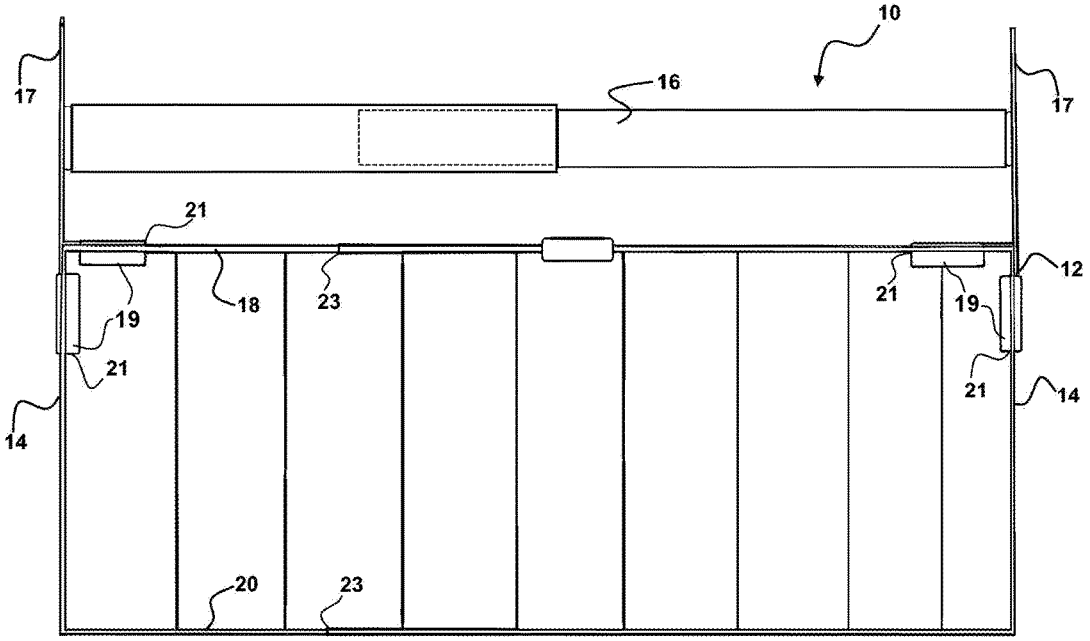
FIG. 2 shows a gate or frame having a telescopic mounting member mounted above, and showing a telescopic frame configured to widen or shorten for engagement in positions of various widths, where clips which have slots for engagement to a provided or to an existing frame, to hold mounts for the mounting member, and showing the annular projections in any gaps between rotating members.

In all modes, above a top edge 16 of the frame 12, is operatively positioned a mounting member 16 (FIG. 2.) This mounting member 16 can be telescopic in length or fixed in length between a first end and second end, to allow easy engagement and removal with opposing mounts 17 engaged with the frame 12. A spring or other biasing means would be operatively positioned within the two telescopically engaged sections of the mounting member 16 to bias the two opposing ends in opposite directions which will automatically adjust the width of the mounting member 16 as the frame 12 widens or collapses if the frame is also telescopically configured. However, even where the frame 12 is fixed in width between the two sides 14, a spring loaded or otherwise biased and telescopically engaged mounting member 16 will allow for easy engagement and disengagement from the mounts 17 with the frame 12.

If the frame 12 is formed to telescopically 23 expand and contract in total width between the two sides 14, then as noted, it would be preferable that the mounting member 16 also have sections which translate concurrently to lengthen or decrease in length. The frame 16 may have a top member 18 defining a top edge and a bottom member 20 defining a bottom edge of the frame 12 which are telescopically 23 configured to allow the frame 12 to increase or decrease in width between the sides 14. Alternatively, the frame 12 may be formed in a plurality of pieces which translate in a parallel engagement (not shown) to provide an adjustment in width between the two sides 14.

Figure 5:
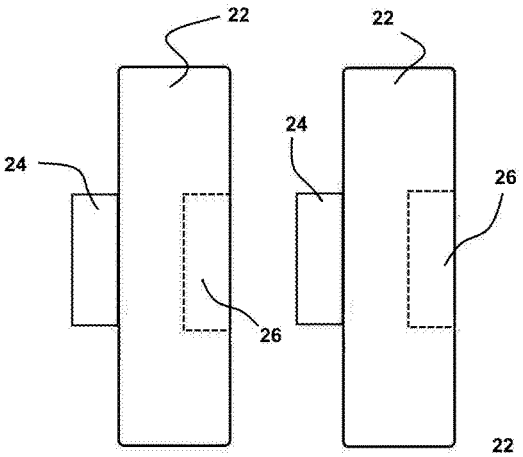
FIG. 5 is a view of the annular projections and annular recesses preferably present in all modes of the rotating members.
Figure 6:
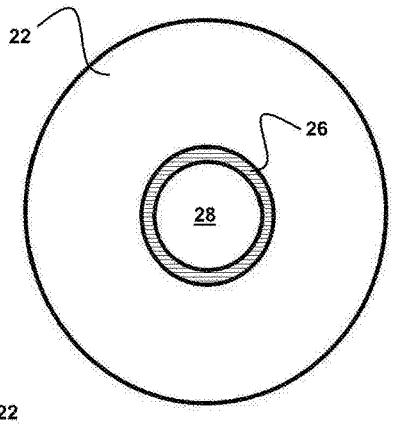
FIG. 6 is an end view of a rotating member showing the central passage communicating axially through the rotating member and the annular member and the annular recess.
Figure 7:
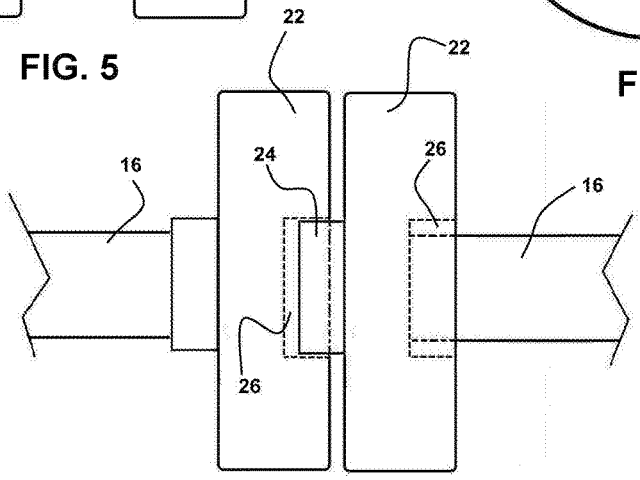
FIG. 7 shows the typical engagement of annular projections within annular recesses where the adjacent rotating members are freely rotating on a mounting member.

As shown in FIGS. 1 and 2, and in enlarged form in FIGS. 5 and 7, each of the plurality of rotating members 22 is positioned for rotation in either direction upon the mounting member 16. On a first side of the rotating members 22 an annular projection 24 extends to a distal end. On an opposite second side of each of the rotating members an annular recess 26 depends into the second side. An axial passage 28 (FIG. 6) communicates through the annular projection 24 through the body of the rotating member 22 to the annular recess 26. Each of the rotating members 22 is engaged upon the mounting member 16 by passage of the mounting member 16 through the axial passage 28.

As noted, this configuration of axial projection 24 into an adjacent axial recess 26 of an adjacent rotating member 22, positions the axial projection 24 within any gaps 30 between adjacent rotating members 22 which might be large enough for a finger or hair of a child to enter. The annular projections 24 in each gap 30 rotate at the same speed as the rotating member 22 and help to prevent pinching which could occur in wider gaps 30. While such might not be a concern where the gaps 30 are extremely narrow, where they widen due to expansion of the frame 12 width, these annular projections 24 become most preferred.

Figure 3:
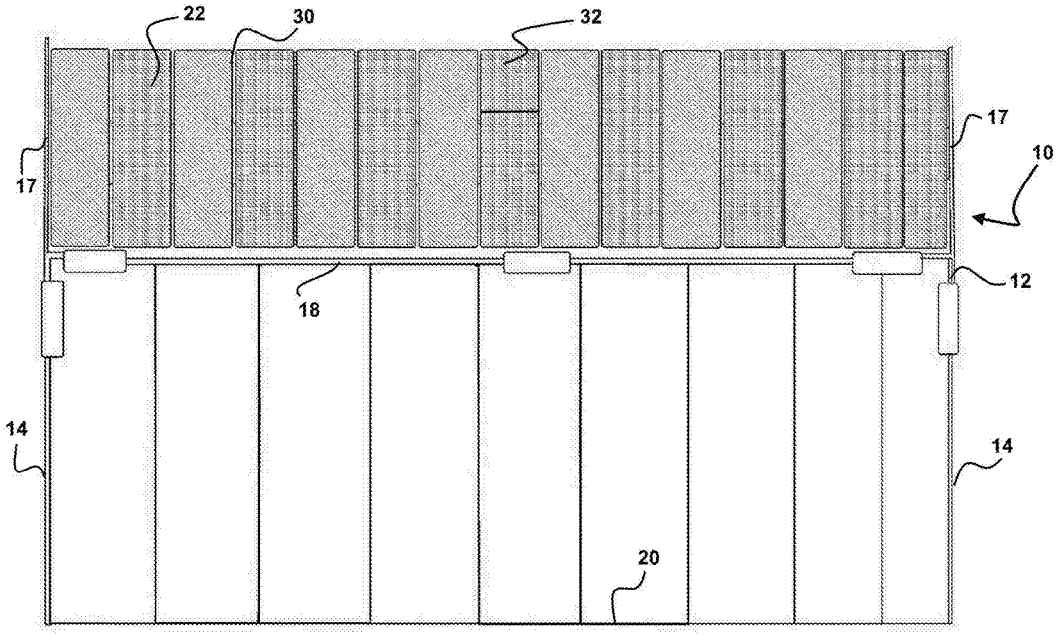
FIG. 3 depicts the device with different colored rotating members.

Shown in FIG. 3 is a mode of the device 10 wherein the plurality of rotating members 22 have colors or patterns which are different than others in the plurality of rotating members 22, or preferably, have a plurality of colorized sections 32 running around the circumferential surface of each of the rotating members 22. Such will allow the child to align or dis-align the colorized sections 32 to form bands and patterns of color.

Figure 4:
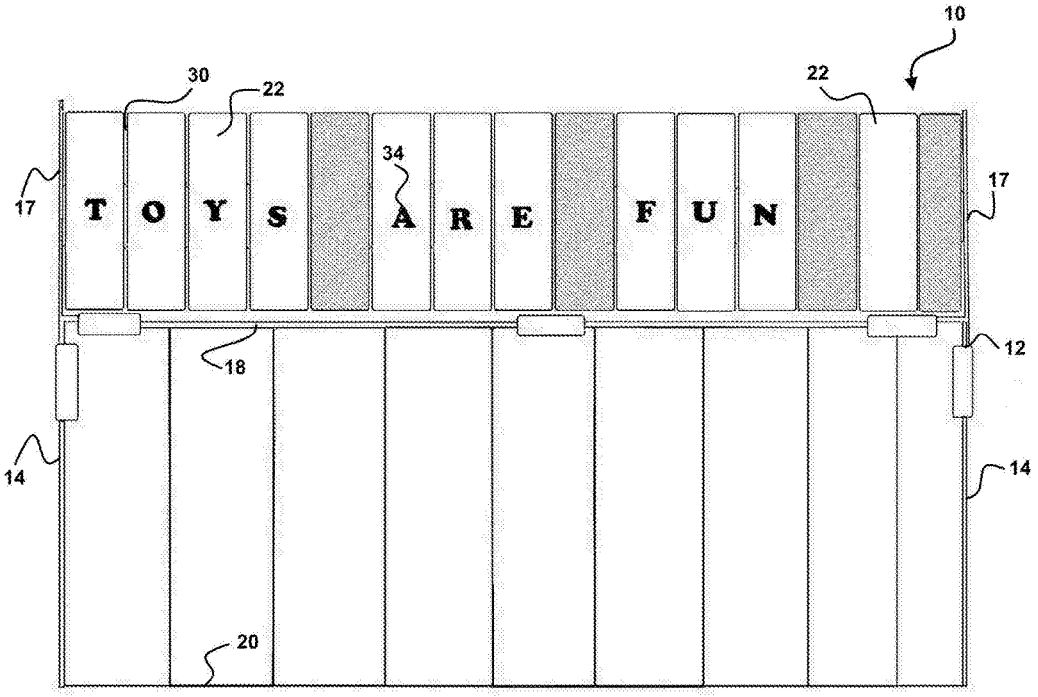
FIG. 4 depicts the device with indicia on some or all rotating members for play or education.

The rotating members 22 in FIG. 4, are shown with indicia 34 thereon. This is preferable to allow the child to use the indicia 34, such as letters, to form words and the like.

As noted, in FIG. 5 is shown an enlarged depiction of the annular projections 24 extending from a first side of the rotating members 22 which are adapted for rotational engagement within the annular recesses 26 depending into the second side of the rotating members 22.

In FIG. 6 is shown an end view of a second side of a rotating member 22 showing the annular recess 26 depending into the second side and surrounding the axial passage 28. As noted the axial passage 28 communicates from this intersection with the annular recess 26 and through the body of the rotating member 22 and axially through the projecting member 24 on the first side of the rotating member 22.

As described above, FIG. 7 shows the typical engagement of annular projections 24 extending from a first side of the rotating members 22 within annular recesses 24. This engagement is typical such as shown in FIGS. 1,3 and 4, and where the adjacent rotating members 22 are freely rotating in either direction operatively engaged upon the mounting member 16.

Figure 8:
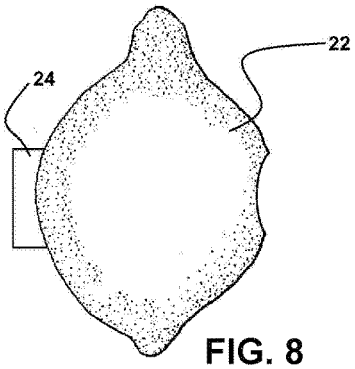
FIG. 8 depicts a rotating member shaped as a lemon to show the rotating members can be any shape.
Figure 9:
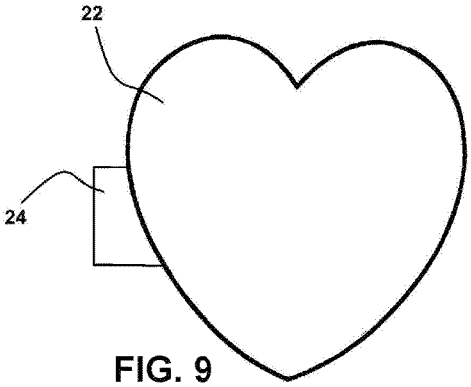
FIG. 9 shows a rotating member in the shape of a heart.

As noted the rotating members 22 can be irregular in shape or depict familiar objects or the like. An example of such is shown in FIG. 8 which depicts a rotating member 22 shaped as a lemon, and in FIG. 9 showing a rotating member 22 formed to a heart shape.

Figure 10:
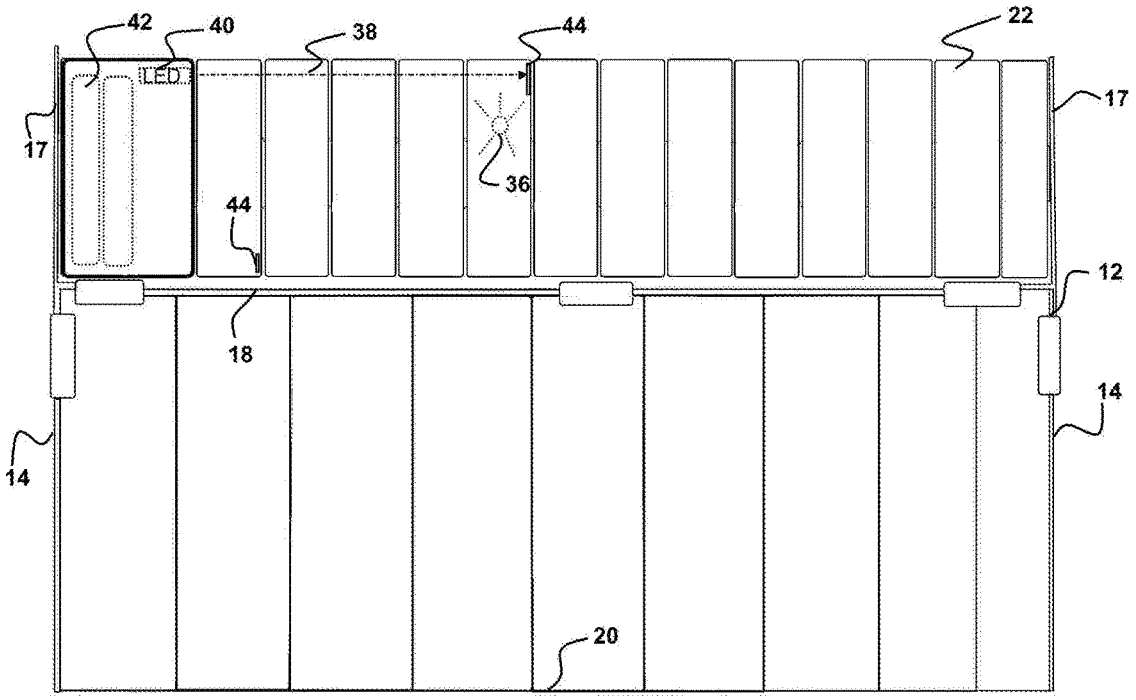
FIG. 10 depicts a mode of the device having emitters located in one or a plurality of the rotating members which are adapted to emit sound, light, or both, upon triggering by positioning of a rotating member to intersect a light beam.

In FIG. 10 is shown a mode of the device 10 where emitters 36 are positioned in one or a plurality of the rotating members 22. These emitters 36 are configured to generate sound, light, or both, upon triggering which is accomplished by positioning the rotating member 22 to intersect a light beam 38 generated by a light projector 40 such as an LED or small laser which is operatively connected to electric power, such as to batteries 42.

Figure 11:
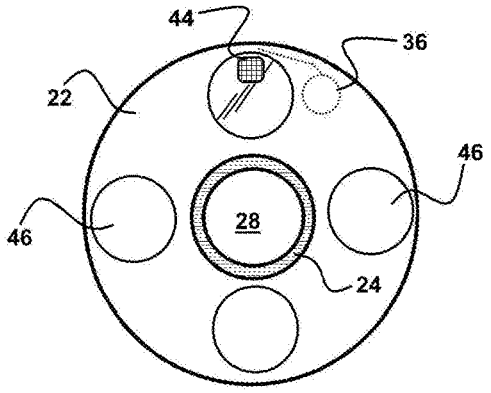
FIG. 11 is a side view of a rotating member having an emitter therein and positionable trigger to actuate it, and showing secondary passages for passage of a light beam therethrough.

FIG. 11 depicts a mode of the rotating members 22 enabling operation of the device as in FIG. 10. As shown, it would require that the child rotate a rotating member 22 such as in FIG. 11, such that a trigger 44 intersects the light beam 38 which is communicated through openings 46 located in the rotating members 22 positioned on the mounting member 16 in-between the light projector 40 and the rotating member 22 of choice with the trigger 44. The trigger 44 can be photovoltaic component which generates electric power upon contact of the light beam 38 which powers the emitter 36. Or, the trigger 44 might be other configurations such as a light sensor which generates electric current only when impacted by the light beam 38, where the electric current is employed to close a switch between a battery and the emitter 36 causing light, sound, or both to be generated.

It should be noted than any of the different depicted and described configurations and components of the barrier for a doorway or passage in different drawn figures, can be employed with any other configuration or component shown and described as part of the device herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A doorway and passage barrier comprising:

a mounting assembly, said mounting assembly having a first mount and a second mount, each positionable to a respective engagement upon a frame forming a gate or barrier, at opposing ends of said frame in an engaged position;

said engagement of said first mount formed by a first connector positioned on said first mount, said first connector having a first slot therein sized to engage opposing side surfaces of portions of said frame therein, at a first connection;

said engagement of said second mount formed by a second connector positioned on said first mount, said second connector having a second slot therein sized to engage opposing side surfaces of portions of said frame therein, at a second connection;

said first mount in said first connection and said second mount in said second connection, both extending above a top edge of said frame and having a space therebetween;

a plurality of rotating members each having a first side opposite a second side thereof;

each of said rotating members having an annular member extending from the respective second side thereof to a distal end of said annular member;

each of said plurality of rotating members having an axial passage communicating between the respective first side thereof to the respective distal end of the annular member extending from the respective second side thereof;

a mounting member having a first end thereof connected to said first mount and a second end thereof connected to said second mount;

said mounting member communicating through each respective axial passage of each of said plurality of rotating members;

each of said plurality of rotating members rotating freely upon said mounting member in either of two directions;

each said annular projection having a diameter sized to slide within an annular recess formed into the respective first side of each of the other of the plurality of rotating members positioned upon said mounting member;

each said annular projection forming an annular shield preventing contact with said mounting member within gaps formed between the plurality of rotating members positioned upon said mounting member; and said plurality of rotating members rotating upon said mounting member defining a rotating shield above said top edge of said frame, said rotating shield preventing contact with said top edge.

2. The doorway and passage barrier of claim 1, additionally comprising:

indicia positioned on some of said plurality of rotating members; and said indicia positionable to form words or color patterns.

3. The doorway and passage barrier of claim 1, additionally comprising:

emitters located within at some of said plurality of rotating members, said emitters for generating sound or light;

a light projector generating a light beam; and a trigger operatively connected to each of said emitters, each said trigger energizing a respective said emitter to thereby generate said light or sound upon a communication of said light beam upon said trigger.

4. The doorway and passage barrier of claim 1, additionally comprising:

each of said plurality of rotating members having a diameter between 2.5 to 3.5 inches.

* * * * *